US005620250A

United States Patent [19]

Chilcoat et al.

[11] Patent Number: 5,620,250

[45] Date of Patent: Apr. 15, 1997

[54] JET MIXER HAVING A SELF-CENTERING LIQUID BEARING HUB ARRANGEMENT

[75] Inventors: Mark E. Chilcoat, Kent; James W. Althouse, III, Hudson, both of Ohio

[73] Assignee: Pro-Quip, Inc., Macedonia, Ohio

[21] Appl. No.: 610,836

[22] Filed: Mar. 5, 1996

[51] Int. Cl.[6] ..... B01F 5/02

[52] U.S. Cl. ..... 366/168.2; 366/170.3; 366/280; 366/331; 239/233; 239/261

[58] Field of Search ..... 366/167.2, 168.2, 366/169.1, 170.3, 170.4, 270, 280, 314, 330.1, 330.2, 331; 415/80; 416/20 R, 20 A; 239/231, 233, 259, 261, 264

[56] References Cited

U.S. PATENT DOCUMENTS

| | | | |
|---|---|---|---|
| 503,577 | 8/1893 | Burnham, Jr. . | |
| 1,073,878 | 9/1913 | Trent . | |
| 1,156,946 | 10/1915 | Vandercook | 366/168.2 X |
| 1,180,170 | 4/1916 | Marsh et al. | 239/259 X |
| 1,214,113 | 1/1917 | Anderson . | |
| 1,723,014 | 8/1929 | Dahllof | 239/259 |
| 2,559,518 | 7/1951 | Smith . | |
| 2,563,962 | 8/1951 | Rieger | 239/261 X |
| 2,592,904 | 4/1952 | Jackson | 366/168.2 |
| 2,652,228 | 9/1953 | Merrick | 239/259 |
| 2,983,452 | 5/1961 | Lindbloom | 239/259 |
| 3,409,030 | 11/1968 | Schmidt | 239/261 X |
| 3,862,747 | 1/1975 | Richter . | |
| 4,184,775 | 1/1980 | Akizawa | 366/169 |
| 4,188,287 | 2/1980 | Faulkner et al. . | |
| 4,193,702 | 3/1980 | Davis | 366/343 |
| 4,249,828 | 2/1981 | Condolios | 366/102 |
| 4,582,255 | 4/1986 | Won | 239/261 X |
| 4,688,945 | 8/1987 | Brazelton et al. | 366/156 |
| 4,721,394 | 1/1988 | Casto et al. | 366/343 |
| 4,838,703 | 6/1989 | McMaster et al. | 366/169 |
| 5,061,080 | 10/1991 | MacKay et al. | 366/169 |

*Primary Examiner*—Charles E. Cooley
*Attorney, Agent, or Firm*—D. Peter Hochberg; Mark Kusner

[57] ABSTRACT

A jet mixer having a hub arrangement for facilitating the rotation of an impeller mounted to the hub. The hub receives fluid from a hollow conduit to provide a liquid bearing. The hub includes a sleeve member that is axially self-centering and rotatable on a body portion of the hub.

16 Claims, 4 Drawing Sheets

JET MIXER HAVING A SELF-CENTERING LIQUID BEARING HUB ARRANGEMENT

FIELD OF INVENTION

The present invention relates generally to a rotary mixer and more particularly to a rotary mixer propelled by jet propulsion and having a liquid bearing hub.

BACKGROUND OF INVENTION

Environmental safety concerns may arise where a mixing device is used in an industrial mixing process. In this respect, mixing devices using motors (e.g., electric) to provide rotary motion to a mixing impeller will require a conduit seal where the conduit enters a vessel or tank, in order to prevent leakage of vapors, fumes and liquids from the vessel or tank into the motor's power transmission device. Among the different seals used are vapor and umbrella seals for very low pressure, single mechanical seals for vacuum up to pressures to 75 psi, standard stuffing box seals for pressures up to 150 psi, double mechanical seals from full vacuum pressures to 250 psi, and double balanced mechanical seals for pressures above 250 psi. Vapors and fumes may escape from the vessel or tank due to conduit movements which vibrate the seal thus leading to a failure of the seal. Accordingly, a conduit seal requires frequent maintenance and repair, which may result in considerable down-time. A further drawback to conduit seals is that they can be very expensive.

One solution to the problems posed by conduit seals is to eliminate the need for them altogether. In this respect, mixing devices which do not require a motor and gear box, can eliminate the need for conduit seals. Accordingly, mixing devices which provide rotary motion to the mixing impeller by jet action, rather than by a motor and gear box, do not require conduit seals. This jet action is generated by injecting a fluid through nozzles at the tip ends of the impeller. The thrust action of the fluid discharging from the nozzles causes the impeller to rotate.

Prior art jet mixers have relied on fluid discharge from the nozzles as the primary means of mixing the contents of a tank. A rotating blade, paddle or the like may be used as only a secondary means of mixing. Accordingly, prior art jet mixers have provided insufficient mixing action for numerous applications.

Furthermore, prior art jet mixers have relied upon ball bearings in their hub design. Since the hub of a jet mixer may be exposed to various fluids, including corrosive fluids, the ball bearings and the cage housing the ball bearings must be corrosion resistant. One common way to provide a non-corrosive bearing is to use expensive ceramic bearings. Other drawbacks to typical ball bearing designs is the need to periodically clean and lubricate the bearings, the complexity of the hub design, and the high manufacturing costs.

The present invention overcomes these and other drawbacks of prior art devices and provides an efficient, environmentally safe, sealless mixing device.

SUMMARY OF THE INVENTION

According to the present invention there is provided a jet mixer comprising of a hollow conduit means for carrying a fluid, hub means engageable with the conduit means for receiving the fluid, the hub means having a stationary body portion and a sleeve member arranged around the body portion and rotatable thereabout, impeller means mountable to the sleeve portion, and pump means for pumping the fluid through the conduit means and the hub means.

It is an object of the present invention to provide a mixing device which has improved mixing capabilities over prior art jet mixers.

It is another object of the present invention to provide a mixing device which uses the movement of the mixing impeller to provide primary mixing action and the thrust of fluid exiting from jet nozzles to provide secondary mixing action.

Another object of the present invention is to provide a mixing device which varies the speed of impeller rotation by controlling the flow and pressure of fluids through the system.

A still further object of the present invention is to provide a mixing device which eliminates the need for a ball bearing assembly.

Yet another object of the present invention is to provide a liquid bearing hub having a self-centering sleeve.

It is another object of the present invention to provide a mixing device which does not require a conduit seal.

It is another object of the present invention is to provide a mixing device which improves environmental safety and eliminates air quality contamination.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED INVENTION

Figure 1:
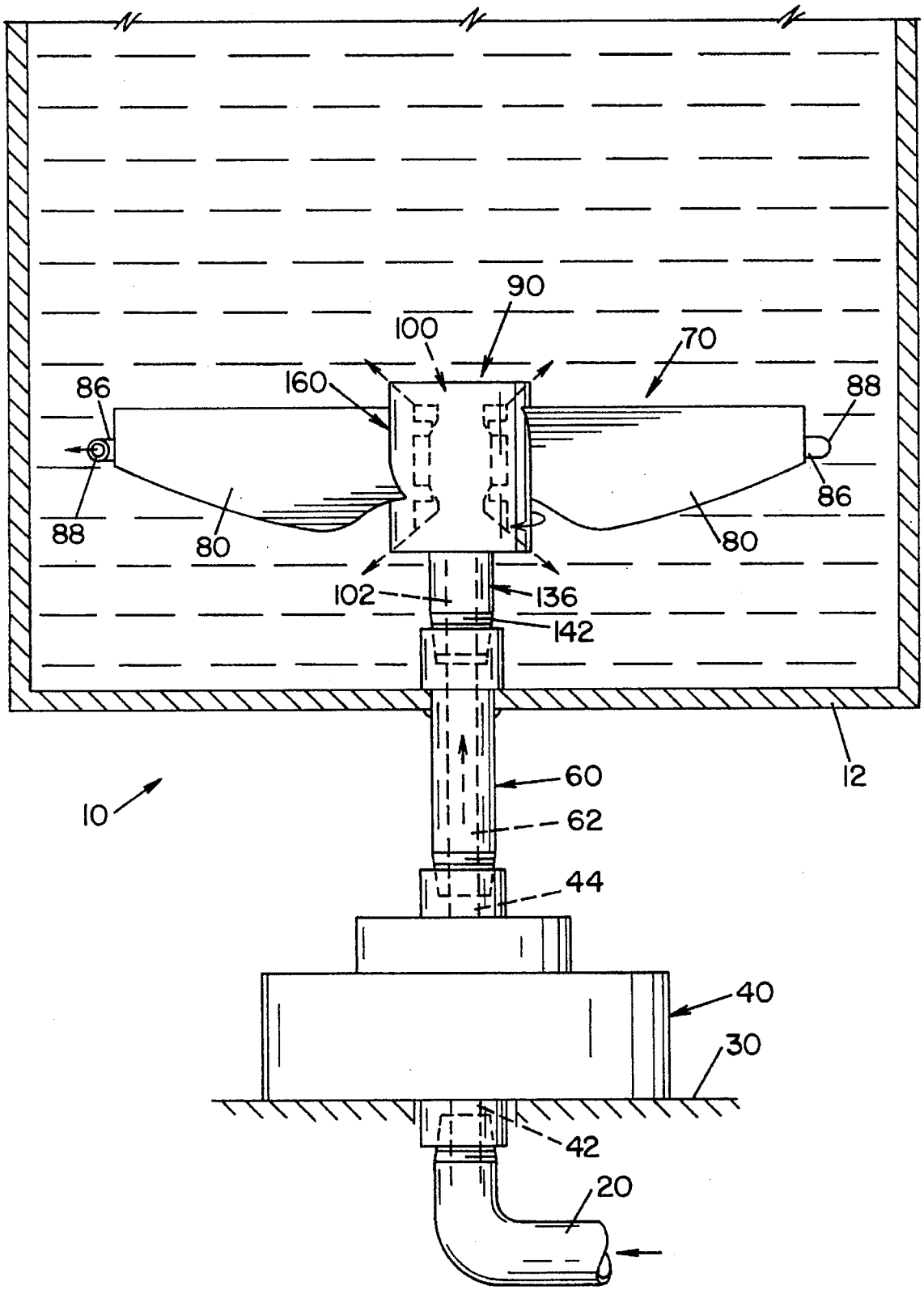
FIG. 1 is a sectional view of the jet mixer according to a preferred embodiment of the present invention.
Figure 2:
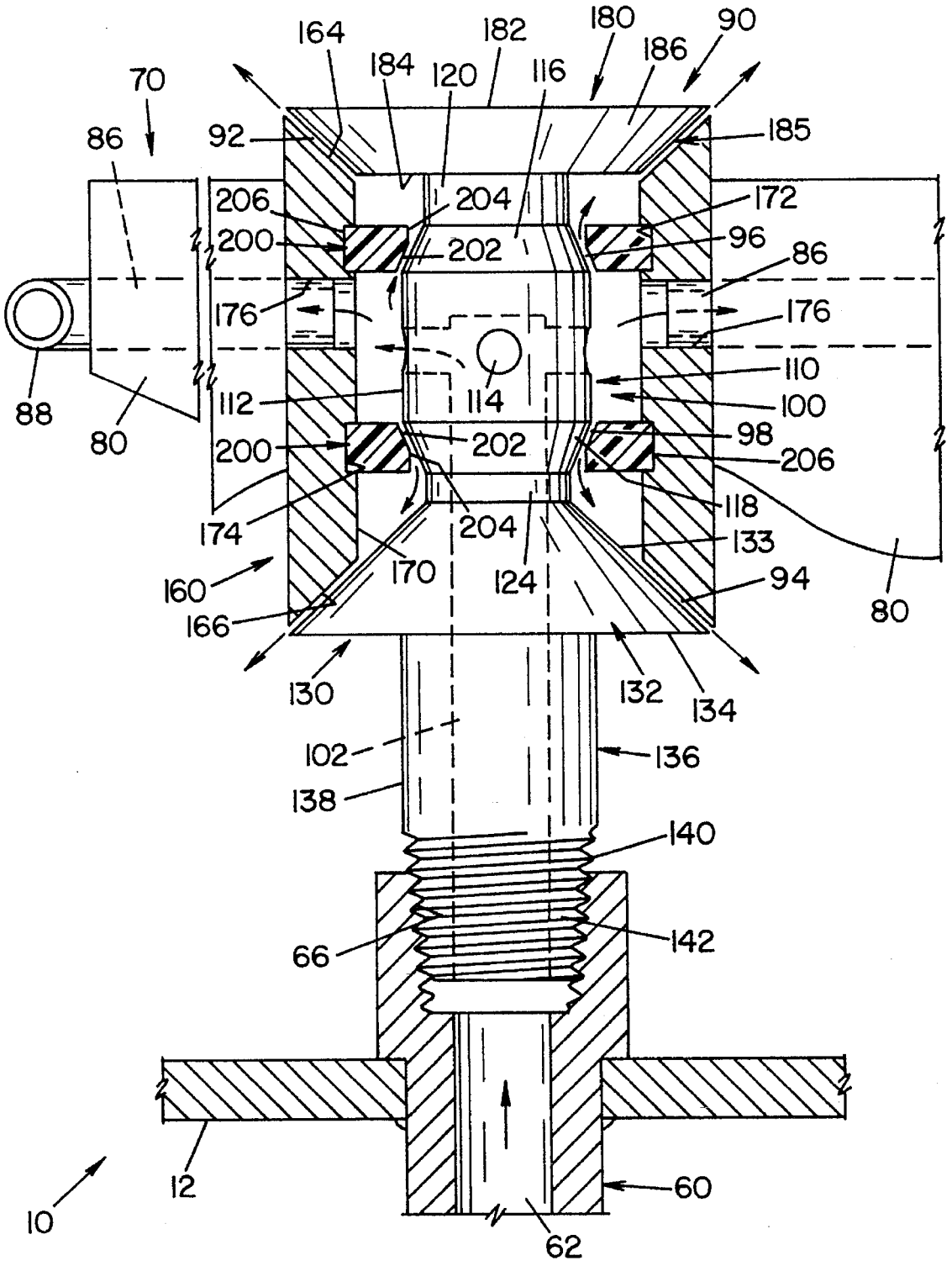
FIG. 2 is an enlarged sectional view of the jet mixer shown in FIG. 1.

Referring now to the drawings wherein the showing is for the purpose of illustrating a preferred embodiment of the invention only, and not for the purpose of limiting same, FIG. 1 shows a mixing device 10 according to a preferred embodiment of the present invention. An enlarged sectional view of mixing device 10 is shown in FIG. 2.

Mixing device 10 is generally comprised of a vessel or tank 12, a pump 40, a conduit 60, an impeller 70, and a hub 90.

It should be appreciated that while conduit 60 is shown entering tank 12 from the bottom of tank 12, conduit 60 may also enter tank 12 from the top or sides of tank 12. Furthermore, impeller 70 may have various orientations relative to the walls of tank 12.

Pump 40 has an input port 42 for receiving fluid from an inlet pipe 20, and an output port 44 for transferring fluid through conduit 60 to hub 90.

A support member 30 supports pump 40 outside tank 12. Inlet pipe 20 is inserted through an opening in mounting surface 30 and attaches to input port 42. As noted above, fluid exits pump 40 through output port 44 and flows through conduit 60 to hub 90. Pump 40 may be of any type known in the art. However, the choice of pumps may be influenced by the velocity of fluid flow desired, the rotation speed desired, the size of the tank, and the type of fluid in the tank. It should also be appreciated that pump 40 may have various power sources, including electricity.

Conduit 60 is a hollow cylindrical conduit having a bore 62 located along its longitudinal axis. Conduit 60 is threadingly engaged with both output port 44 and hub 90 to convey fluid from output port 44 to hub 90. It should be appreciated that the construction materials of conduit 60 must be sufficient to withstand any corrosive materials in tank 12, as well as the pressure forces developed inside bore 62 as fluid is forced through bore 62 by pump 40. Accordingly, conduit 60 is preferably constructed of a strong non-corrosive material, such as stainless steel.

Figure 3:
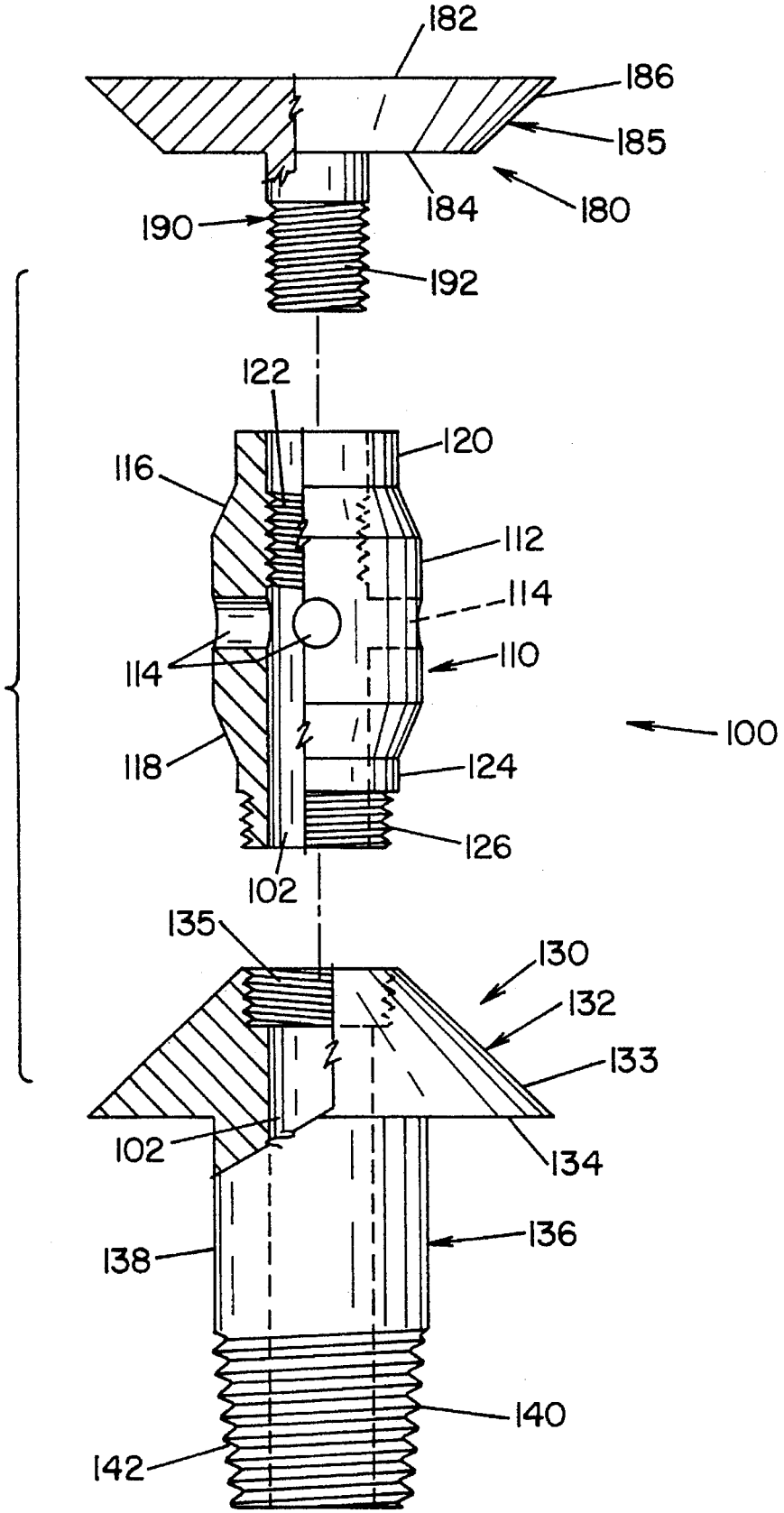
FIG. 3 is an exploded view of the main body member of the jet mixer hub shown in FIG. 1.

Hub 90 is a liquid bearing hub generally comprising a main body member 100 and a sleeve member 160 (see FIG. 2). As best seen in FIG. 3, main body member 100 is generally comprised of a barrel portion 110, a lower conical portion 130, and an upper conical portion 180. It should be appreciated that the terms "upper" and "lower" as used herein are used merely for the purpose of describing a preferred embodiment of the present invention, and are not intended to limit same.

Barrel portion 110 is generally comprised of a central section 112, upper and lower tapered sections 116 and 118, and upper and lower connecting sections 120 and 124. Central section 112 has a generally cylindrical shape, and includes a plurality of openings 114. Openings 114 extend from the outer surface of central section 112 to an inner bore 102, which extends longitudinally along a portion of main body member 100. Inner bore 102 will be described below in further detail.

Upper tapered section 116 and lower tapered section 118 have generally conical surfaces. Upper tapered section 116 tapers from central section 112 to upper connecting section 120, whereas lower tapered section 118 tapers from central section 112 to lower connecting section 124.

Upper connecting section 120 has a generally cylindrical shape. A threaded bore 122 is formed along the longitudinal axis of upper connecting section 120 to facilitate the connection of upper conical portion 180 to barrel portion 110. Upper conical portion 180 will be described in greater detail below.

Lower connecting section 124 has a generally cylindrical shape. Lower connecting section 124 includes a threaded stem 126 for facilitating the connection of lower conical portion 130 to barrel portion 110.

Lower conical portion 130 is generally comprised of a tapered section 132 and a stem section 136. Tapered section 132 has a generally conical surface 133, a threaded bore 135, and a generally planar lower surface 134. Threaded bore 135 is dimensioned to receive threaded portion 126 of barrel portion 110.

Stem section 136 of lower conical portion 130 extends downward from lower surface 134 of tapered section 132. Stem section 136 includes a cylindrical surface 138 and an annular tapered surface 140. Threads 142 are formed on the outer surface of tapered surface 140 to facilitate connection of conical portion 130 to conduit 60. In this respect, conduit 60 includes mating threads for threaded engagement with threads 142.

As mentioned above, an inner bore 102 is formed along the longitudinal axis of main body portion 100. Inner bore 102 extends through lower conical portion 130 and through a portion of barrel portion 110, as seen in FIG. 3. Bore 102 interfaces with bore 62 of conduit 60 to provide a passageway for fluid exiting from bore 62. This fluid will exit through openings 114 of barrel portion 110.

Upper conical portion 180 is generally comprised of a tapered section 185 and a stem section 190. Tapered section 185 has a generally conical surface 186, and generally planar upper and lower surfaces 182 and 184. Stem section 190 extends downward from lower surface 184. Threads 192 are formed on the outer surface of stem section 190 to facilitate connection of upper conical portion 180 to barrel portion 110. As discussed above, barrel portion 110 includes a threaded bore 122 dimensioned to receive stem section 190 in threaded engagement.

Figure 4:
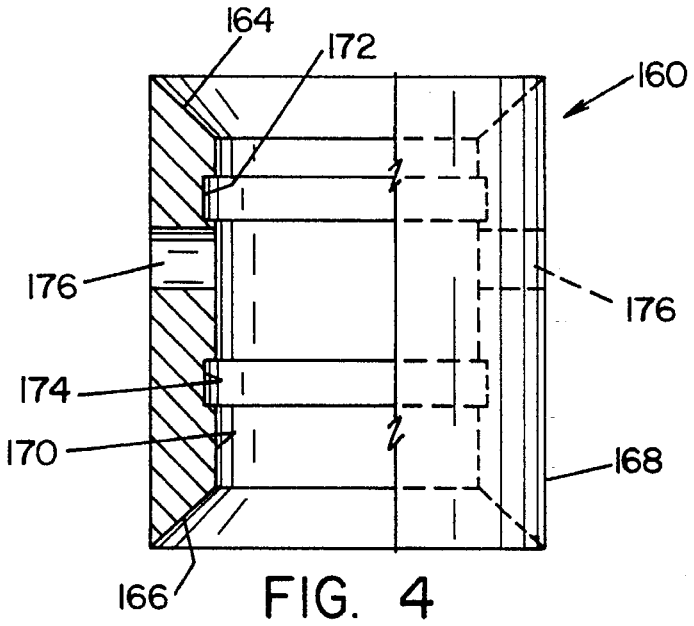
FIG. 4 is a sectional view of the sleeve portion of the jet mixer hub shown in FIG. 1.

Referring now to FIG. 4, there is shown a preferred embodiment of sleeve member 160. Sleeve member 160 has a generally cylindrical shape, and has an upper annular tapered surface 164, a lower annular tapered surface 166, a generally cylindrical outer surface 168 and a generally cylindrical inner surface 170.

A pair of annular recesses 172 and 174 are formed along inner surface 170. Annular recesses 172 and 174 are dimensioned to receive ring members 200, which will be described in detail below. A pair of openings 176 are also formed along inner surface 170 to receive tube 86 of impeller 70, which will also be described in greater detail below. Sleeve member 160 has an inner diameter dimensioned such that sleeve member 160 fits over barrel portion 110, as seen in FIG. 2. In this regard, sleeve member 160 must be free to rotate about barrel portion 110 during operation of mixing device 10.

Figure 5:
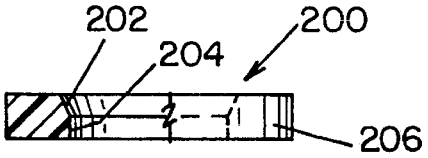
FIG. 5 is a sectional view of a ring member of the jet mixer hub shown in FIG. 1.

Referring now to FIG. 5, there is shown a preferred embodiment of ring members 200. Ring members 200 have a tapered inner surface 202, a cylindrical inner surface 204, and a cylindrical outer surface 206. Ring members 200 are preferably formed of a strong, durable, non-corrosive material such as Teflon®. As indicated above, ring members 200 are dimensioned to be received within annular recesses 172 and 174, as seen in FIG. 2.

It should be appreciated that main body member 100 and sleeve member 160 may be constructed of various materials depending upon the particular application for the jet mixer. Examples of typical materials include carbon steel, stainless steel, and titanium.

Figure 6:
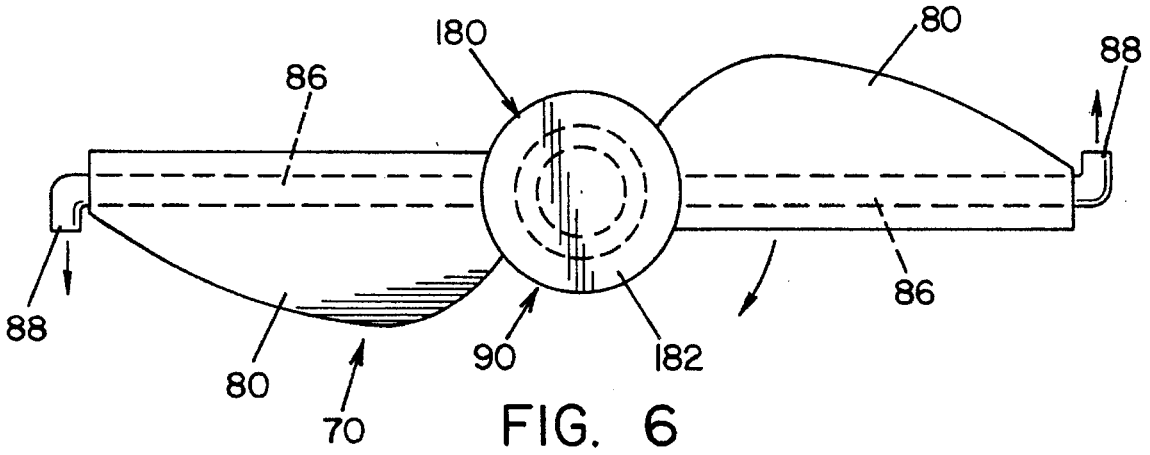
FIG. 6 is a top plan view of the jet mixer according to a preferred embodiment of the present invention.

Impeller 70, as seen in FIGS. 1, 2 and 6, is generally comprised of a pair of tubes 86 and a pair of blades 80. It will be appreciated that vanes, paddles, or the like may be substituted for blades 80. Tubes 86 are received in openings 176 of sleeve member 160, and extend radially outward therefrom. Nozzles 88 are formed at the outermost ends of tubes 86. According to a preferred embodiment of the present invention, nozzles 88 are generally perpendicular to the longitudinal axis of tubes 86, and will direct fluid from tubes 86 in opposite directions, as seen in FIG. 6. It will be appreciated that the diameter and direction of nozzles 88 may vary, depending upon several variables, including the desired speed of rotation, pumping capacities, blade type, and fluid rates. Furthermore, it should also be appreciated that impeller 70 may be comprised of any number of blades 80, depending upon the mixing application.

Blades 80 are attached to tubes 86 by fasteners (e.g., bolts) or other means known in the art. Alternatively, channels or ducts may be formed within blades 80, and thus eliminated the need for tubes 86. It will be appreciated that blades 80 may take any number of forms depending on the particular mixing application. The blades shown in FIGS. 1 and 6 are solely for the purpose of illustrating a preferred embodiment of the present invention, and are not intended to limit same. Furthermore, blades 80 may be constructed of stainless steel, nickel, titanium, plastic or other suitable material.

Hub 90 is assembled in the following manner. Lower conical portion 130 of hub 90 is threadingly engaged with conduit 60. In this respect, threads 142 of stem section 136 are engaged with threaded portion 66 of conduit 60.

Impeller 70 is attached to sleeve member 160 by inserting tubes 86 in openings 176. Sleeve member 160 is then placed over barrel portion 110, so that barrel portion 110 is contained within sleeve member 160. Thereafter, ring members 200 are placed in recesses 172 and 174 of sleeve member 160. Barrel portion 110 is then threadingly engaged with lower and upper conical portions 130 and 180. In this respect, threaded stem 126 of barrel portion 110 engages with the threads inside threaded receiving bore 135 of lower conical portion. Similarly, cap portion 180 is threadingly engaged with barrel portion 110. In this respect, threads 192 of stem section 190 are engaged with the threads formed within threaded bore 122.

When fully assembled, hub 90 will be arranged in the manner shown in FIG. 2. In this respect, tapered inner surface 202 and cylindrical inner surface 204 of ring members 200 will be arranged adjacent to upper and lower tapered sections 116 and 118 of barrel portion 110. Annular gaps 96 and 98 are defined therebetween to allow fluid exiting openings 114 to pass therethrough. Furthermore, upper tapered surface 164 of sleeve member 160 is generally parallel and adjacent to annular tapered surface 186 of upper conical portion 180. An annular slot 92 is defined therebetween for the passage of fluid into tank 12. Likewise, lower tapered surface 166 of sleeve member 160 is generally parallel and adjacent to conical surface 133 of lower conical portion 130. An annular slot 94 is defined therebetween for the passage of fluid into tank 12. The fluid passing through slots 92 and 94 provides the liquid bearing surfaces.

It should be understood that ring members 200 serve multiple functions. First, ring members 200 prevent friction and wear as sleeve member 160 rotates about barrel portion 110. Ring members 200 also keep the central axis of sleeve member 160 generally aligned with the central axis of barrel portion 110. Another important function of ring members 200 is that they axially "center" sleeve member 160. In this respect, if sleeve member 160 begins to ride too high along the longitudinal axis of barrel portion 110, the arrangement of ring members 200 relative to tapered sections 116 and 118 will cause recentering (i.e., returning sleeve member 160 to its neutral center position).

If sleeve member 160 is allowed to ride up too high along the longitudinal axis of hub 90, then slot 92 will narrow and let less fluid pass therethrough, and slot 94 will widen, thus allowing more fluid to pass therethrough. If sleeve member 160 is allowed to move downward too low along the longitudinal axis of hub 90, then slot 92 will widen, thus letting more fluid pass therethrough, while at the same time slot 94 will narrow letting less fluid pass therethrough. It should be noted that if the amount of fluid passing through either slot 92 or 94 is insufficient, hub 90 will fail to provide a liquid bearing surface.

According to the present invention, if sleeve member 160 begins moving upward from its neutral center position, slot 92 will narrow and slot 94 will widen. At the same time gap 96 will widen and gap 98 will narrow. Accordingly, a greater volume of fluid will be allowed to pass through gap 96 to slot 92, while a reduced volume of fluid will be allowed to pass through gap 98 to slot 94.

By automatically adjusting the flow of fluid to slots 92 and 94, ring members 200 will cause sleeve member 160 to return its neutral central position. Hence, ring members 200 provide a flow control for centering sleeve member 160, and thus maintaining sufficient fluid flow through slots 92 and 94.

In a similar manner, if sleeve member 160 begins moving downward from its neutral center position, slot 92 will widen and slot 94 will narrow. At the same time gap 96 will narrow and gap 98 will widen. Accordingly, a greater volume of fluid will be allowed to pass through gap 98 to slot 94, while a reduced volume of fluid will be allowed to pass through gap 96 to slot 92.

Jet mixer 10 operates in the following manner. Pump 40 receives fluid from inlet pipe 20. While the fluid is preferably a liquid, it may also be a gas. It should be noted that the fluid may originate from tank 12 and be recirculated through jet mixer 10. Pump 40 then pumps the fluid out through output portion 44 to bore 62 of conduit 60. The fluid will continue flowing through bore 102 of hub 90. The fluid exits through openings 114 in barrel portion 110. Once outside barrel portion 110, the fluid will flow through gaps 96 and 98 defined by ring members 200 and upper and lower tapered sections 116 and 118 and through tubes 86 of impeller 70. Fluid exiting through gaps 96 and 98 will flow through slots 92 and 94. The fluid flowing through slots 92 and 94 provides a liquid bearing surface for hub 90. The fluid flowing through tubes 86 will exit through nozzles 88 into tank 12. The fluid exiting nozzles 88 creates a thrust which causes impeller 70 to rotate in a direction opposite to the direction in which the fluid exits nozzles 88. The speed of rotating impeller 70 will vary depending upon the amount of fluid flowing through nozzles 88 and the rate of such flow. The greater the pressure, the greater the speed. Rotation of impeller 70 is the primary means by which contents in tank 12 are mixed, while the fluid discharged from nozzles 88 provides the secondary means for mixing the contents of tank 12. It should be understood that some of the contents of tank 12 may be recirculated through the nozzles 88. Accordingly, the contents of tank 12 are used to rotate impeller 70 and to provide a liquid bearing surface in hub 90.

It should be noted that if too much fluid passes through slots 92 and 94, then the amount of fluid passing through tubes 86 and nozzles 88 may be insufficient to provide the amount of thrust required for rotation of impeller 70. Similarly, if too little fluid passes through slots 92 and 94, there may be insufficient fluid flow to provide a liquid bearing surface. If so, impeller 70 may not turn due to the lack of a sufficient bearing surface. Accordingly, the angle of upper tapered surface 164 and annular tapered surface 186, and lower tapered surface 166 and conical surface 133 may have varying angles, so as to provide slots 92 and 94 with varying angles. It should be appreciated that slots 92 and 94 may each have a different angle. The angle may depend upon various design parameters, including the weight and size of blade 80 and the thrust required to rotate impeller 70. For instance, a small impeller having a diameter of 6 inches would require a slot angle of approximately 45° from the horizontal, whereas a large impeller having a diameter of 48 inches (and weighing in the range of 100–150 lbs.) would require a slot angle of approximately 30° from the horizontal. While the slot angle may vary depending upon the specific arrangement, the slot angle will typically be in a range of approximately 30°–60° from the horizontal. It should be appreciated that smaller, lighter impellers will typically have a slot angle in the range of approximately 45°–60° from the horizontal, to provide lateral centering. In contrast, larger, heavier impellers will typically have a slot angle in the range of 30°–45° from the horizontal, to provide vertical centering. In general, the slot angle will decrease as the impeller weight increases.

A hub design according to a preferred embodiment of the present invention provides several advantages over conventional ball bearing hub assemblies. In this regard, the hub design of the present invention reduces substantially the number of moving parts, and is self-cleaning. Thus, maintenance costs are reduced. Furthermore, the hub design of the present invention uses a minimal number of parts. Therefore, design, manufacture and assembly of the present invention is easier than prior art hub assembly designs. Moreover, by using liquid to provide a bearing surface, rather than balls or other solid bearings, the problem of corrosion is also eliminated. Furthermore, liquid bearings are compatible with a jet mixer, since the fluid used to provide the bearing surface is also used to provide thrust for rotating the jet mixer impeller.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

The invention claimed is:

1. A jet mixer for a fluid comprising:

fluid conduit means for transmitting fluid, hub means engageable with the fluid conduit means for receiving fluid therefrom, said hub means comprising:

a body portion;

a sleeve member rotatable about said body portion, said sleeve member and said body portion defining a plurality of slots having a variable area for the passage of fluid therethrough, wherein said fluid acts as a bearing between the body portion and the sleeve member, and a plurality of ring means arranged between the body portion and the sleeve member, each said ring means and said body portion defining a gap for regulating the amount of fluid passing through said plurality of slots, wherein each said gap varies in size as said sleeve member moves axially; and impeller means mountable to the sleeve member for receiving fluid from said hub means, said impeller means having nozzles for emitting fluid to effect rotation of the impeller means and the sleeve member.

2. A jet mixer according to claim 1, wherein said body portion includes first and second tapered portions, plurality of ring means include said first and second ring means respectively arranged opposite said first and second tapered portions to define said gaps for the passage of the fluid therethrough.

3. A jet mixer according to claim 1, wherein said plurality of slots define first and second slots, said first slot widens and said second slot narrows, when said sleeve member moves in an axial direction from a neutral center position.

4. A jet mixer according to claim 3, wherein said gaps define first and second gaps, said first gap narrows and said second gap widens, when said sleeve member moves in an axial direction from the neutral center position, in order to vary the amount of fluid passing through said first and second slots.

5. A jet mixer according to claim 4, wherein a narrowing of said first gap reduces the flow of the fluid to said first slot and a widening of said second gap increases the flow of the fluid to said second slot, said changes in fluid flow returning said sleeve member to said neutral center position.

6. A jet mixer according to claim 1, wherein said plurality of slots define first and second slots, said first slot narrows and said second slot widens, when said sleeve member moves in an axial direction from a neutral center position.

7. A jet mixer according to claim 6, wherein said gaps define first and second gaps, said first gap widens and said second gap narrows when said sleeve member moves in an axial direction from the neutral center position.

8. A jet mixer according to claim 7, wherein a widening of said first gap increases the flow of the fluid to said first slot and a narrowing of said second gap decreases the flow of the fluid to said second slot, said changes in fluid flow through said first and second slots returning said sleeve member to said neutral center position.

9. A hub arrangement for a mixing impeller comprising:

a body portion;

a sleeve member rotatable about said body portion, said sleeve member and said body portion defining a plurality of slots having a variable area for the passage of fluid therethrough, wherein said fluid acts as a bearing between the body portion and the sleeve member; and a plurality of ring means arranged between said body portion and said sleeve member, each said ring means and said body portion defining a gap for regulating the amount of fluid passing through said plurality of slots, wherein said gap varies in size as said sleeve member moves axially.

10. A hub arrangement according to claim 9, wherein said body portion includes first and second tapered portions, said plurality of ring means include first and second ring means respectively arranged opposite said first and second tapered portions to define said gaps for the passage of the fluid therethrough.

11. A hub arrangement according to claim 9, wherein said plurality of slots define first and second slots, said first slot widens and said second slot narrows, when said sleeve member moves in an axial direction from a neutral center position.

12. A hub arrangement according to claim 11, wherein said gaps define first and second gaps, said first gap narrows and said second gap widens, when said sleeve member moves in an axial direction from the neutral center position, in order to vary the amount of fluid passing through said first and second slots.

13. A hub arrangement according to claim 12, wherein a narrowing of said first gap reduces the flow of the fluid to said first slot and a widening of said second gap increases the flow of the fluid to said second slot, said changes in fluid flow returning said sleeve member to said neutral center position.

14. A hub arrangement according to claim 9, wherein said plurality of slots define first and second slots, said first slot narrows and said second slot widens, when said sleeve member moves in an axial direction from a neutral center position.

15. A hub arrangement according to claim 14, wherein said gaps define first and second gaps, said first gap widens and said second gap narrows when said sleeve member moves in an axial direction from the neutral center position.

16. A hub arrangement according to claim 15, wherein a widening of said first gap increases the flow of the fluid to said first slot and a narrowing of said second gap decreases the flow of the fluid to said second slot, said changes in fluid flow through said first and second slots returning said sleeve member to said neutral center position.

* * * * *